US006923268B2

(12) United States Patent
Totsu

(10) Patent No.: US 6,923,268 B2
(45) Date of Patent: Aug. 2, 2005

(54) ELECTRIC ROTATIONAL TOOL DRIVING SWITCH SYSTEM

(76) Inventor: Katsuyuki Totsu, 32-13, Oshiage 1-chome, Sumida-ku, Tokyo (JP)

( * ) Notice: Subject to any disclaimer, the term of this patent is extended or adjusted under 35 U.S.C. 154(b) by 22 days.

(21) Appl. No.: 10/469,068

(22) PCT Filed: Feb. 20, 2002

(86) PCT No.: PCT/JP02/01446

§ 371 (c)(1),
(2), (4) Date: Aug. 26, 2003

(87) PCT Pub. No.: WO02/068156

PCT Pub. Date: Sep. 6, 2002

(65) Prior Publication Data

US 2004/0089528 A1 May 13, 2004

(30) Foreign Application Priority Data

Feb. 28, 2001 (JP) ..... 2001-53572

(51) Int. Cl.[7] ..... B25B 23/14

(52) U.S. Cl. ..... 173/2; 173/4; 173/170; 173/171

(58) Field of Search ..... 173/2, 4, 11, 104, 173/217, 48, 170, 171

(56) References Cited

U.S. PATENT DOCUMENTS 4,083,270 A * 4/1978 Tomkinson ..... 81/429
4,142,591 A * 3/1979 Himmelstein ..... 173/182
4,328,871 A * 5/1982 Gluskin ..... 173/178
4,361,945 A * 12/1982 Eshghy ..... 29/407.03
5,366,026 A * 11/1994 Maruyama et al. ..... 173/180
5,563,482 A * 10/1996 Shaw et al. ..... 318/272
5,701,961 A * 12/1997 Warner et al. ..... 173/15
6,341,533 B1 * 1/2002 Schoeps ..... 73/862.23
6,520,270 B2 * 2/2003 Wissmach et al. ..... 173/170

FOREIGN PATENT DOCUMENTS

| | | |
|---|---|---|
| JP | S57-43389 | 9/1982 |
| JP | S60-3960 | 1/1985 |
| JP | S60-13798 | 4/1985 |
| JP | S2-4765 | 1/1990 |
| JP | S3-190684 | 8/1991 |
| JP | S4-171182 | 6/1992 |
| JP | H5-16149 | 3/1993 |
| JP | H7-20267 | 4/1995 |

* cited by examiner

*Primary Examiner*—Scott A. Smith
(74) *Attorney, Agent, or Firm*—Koda & Androlia

(57) ABSTRACT

An electric or power rotational tool including a driving switch of a push operating system that switches the electric motor ON when the rotational tool contacts a work object such as a screw, etc. and is displaced by being pressed, and a driving switch of a lever operating system that switches the electric motor ON when a switch lever installed in the grip portion of the electric rotational tool is displaced by being pressed. Each of the driving switches is constructed by a combination of a magnet and a magnetic sensor, and the magnetic sensor is connected to the power circuit of the electric motor, so that either one of operating systems is selected; and the driving of the electric motor is initiated by switching the power circuit ON through a magnetism sensing action of the magnetic sensor of the selected operating system.

28 Claims, 6 Drawing Sheets

ELECTRIC ROTATIONAL TOOL DRIVING SWITCH SYSTEM

TECHNICAL FIELD

The present invention relates to an electric rotational tool such as an electric driver or the like and more particularly to an electric rotational tool driving switch system in which a driving switch that makes it possible to achieve driving control that is suited to the content of the work when the electric rotational tool is used can be set, handling can be simplified, and the tightening of suitable screws or the like can always be performed easily and safely.

BACKGROUND ART

Electric rotational tools, which are constructed so that the driving of an electric motor is initiated by operating a driving switch, work such as the tightening of screws etc. is accomplished by driving a rotational tool such as a driver bit or the like by means of the driving of this electric motor, the load torque that is generated in the rotational tool when the work is completed is detected by a torque detection means, and, when the detected load torque reaches a torque value that has been preset by a combination of a torque adjustment spring and a cam, this state is detected by a torque setting automatic stopping means, and the driving of the rotational tool is automatically stopped, have been known in the past as electric rotational tools such as electric drivers or the like that are driven by an electric motor.

For example, drivers, which are constructed so that when a strong opposing load is applied to the driver bit during the tightening of screws or the like, this state in which a specified torque value has been reached is detected by a clutch mechanism that is operated by a preset tightening torque, and the clutch mechanism is operated so that the connection between the output shaft of the electric motor and the driver bit is temporarily broken, have been proposed and put into practical use as electric drivers or the like. Furthermore, electric drivers, which are constructed so that when the clutch mechanism is operated, this state is detected by a limit switch or the like, and the driving of the electric motor is stopped, have also been in practical use (Japanese Patent Application Publication (Kokoku) No. 60-13798).

Furthermore, an automatic power cutting device for an electric rotational tool, which is constructed so that the operation of the clutch mechanism is detected by a magnet piece and a magnetism detecting element (Hall element), and the driving of the electric motor is stopped by cutting the power to the electric motor, has also been proposed (Japanese Patent Application Publication (Kokoku) No. 60-3960).

Furthermore, when a switching circuit is installed in a power supply circuit of electric drivers or the like which have a driver bit that is rotationally driven by an electric motor, and if a specified tightening torque is reached as the completion of the screw tightening approaches, then the load current that flows to the power supply circuit when the electric motor is driven increases to an excessive load current that exceeds a specified value. Accordingly, electric drivers or the like equipped with an automatic power cutting device, which is constructed so that the above-described state is detected and the supply of a driving current to the electric motor is cut off, after which the supply of a driving current to the electric motor is restored when a fixed period of time has elapsed, and which is further constructed so that a switching mechanism is installed in the armature circuit of the electric motor, and the armature circuit of the electric motor is short-circuited when the switching circuit cuts off the supply of a driving current to the electric motor, thus instantaneously stopping the electric motor by regenerative braking, have also been proposed (Japanese Patent Application Publication (Kokoku) No. 57-43389). In the above, since the above-described switching circuit is in an OFF state for only a fixed period of time, this circuit also has a function in which the switching circuit automatically returns to an ON state at the timing of the next screw tightening operation, so that the electric motor is driven, thus allowing immediate initiation of the next screw tightening operation.

Furthermore, in an electric rotational tool of this type, an external AC power supply (commercial power supply) is generally used in the driving control of the electric motor. In this case, a control unit equipped with an AC/DC power conversion function and a torque control function, etc. is used in order to obtain the external AC power supply as a suitable power supply output for the driving of an electric motor. In cases where an ordinary compact DC motor is used as the electric motor, this control unit is constructed as a unit that is independent of the electric rotational tool, and is connected between the AC power supply and electric rotational tool so that driving control of the electric motor is accomplished.

Nowadays, furthermore, brushless motors, which are superior as DC motors in terms of characteristics such as non-contact operation, prevention of noise, high torque and compact size, high-speed rotation and long useful life, etc. and which offer the advantage of maintenance-free operation, have been proposed for use as electric motors in electric rotational tools, and they have seen in practical application. In the case of driving control of such brushless motors, unlike the case of the DC motors, a driving circuit that generates a rotating magnetic field is required. Furthermore, such a driving circuit can be constructed by means of a magnetic pole sensor (a Hall element is generally used) which detects the position of the magnetic poles with respect to the magnet rotor, a driving coil which is excited so that a rotational force in a fixed direction is imparted in accordance with the positions of the rotor magnetic poles, and a special IC circuit which controls the driving of the magnetic pole sensor and driving coil.

The driving circuit constructed in this way can be accommodated as a compact circuit structure together with circuits that have a torque control function, etc. inside the grip portion casing of the electric rotational tool. Accordingly, in cases where a brushless motor is used, a control unit having a structure that is independent of the electric rotational tool such as that described above is unnecessary; and only an AC/DC converter is required, and the driving circuit, etc. can be installed in the electric rotational tool as a simplified structure, so that handling can be simplified.

Furthermore, as a means of simplifying handling in electric rotational tools of this type, push operating systems and lever operating systems have been employed as driving switches for starting the driving of the electric motor. The former push operating system is a system which is constructed as follows: when the operator grips the electric rotational tool and presses the rotational tool, such as a driver bit, etc., that protrudes from the tip end portion against the work object, such as a screw, etc., the rotational tool undergoes elastic displacement in the axial direction, so that a driving switch, such as a micro-switch, etc., is switched ON using this displacement, thus connecting the electric motor to a specified power supply, so that the driving of the electric motor is initiated. On the other hand, the latter lever operating system is constructed as follows: when the operator grips the electric rotational tool and causes the rotational tool such as a driver bit, etc. that protrudes from the tip end portion to contact the work object, such as a screw, etc., the operator arbitrarily presses and displaces a switch lever that is installed on the grip portion of the electric rotational tool, so that a driving switch such as a micro-switch, etc. is switched ON utilizing this displacement, thus connecting the electric motor to a specified power supply so that driving of the electric motor is initiated.

In conventional electric rotational tools, as described above, a micro-switch, etc. is used as the driving switch that initiates driving of the electric motor. As a result, sparks, etc. are generated in the switch contact points at the time of operation. This not only causes wear of the contact points, but also results in the problem of various types of deleterious effects on surrounding electronic parts, electronic equipment and electronic circuits, etc. Accordingly, such a mechanical switch structure not only suffers from limits in terms of achieving a compact size and an increase in the useful life, but also places numerous restrictions on the achievement of a compact size of the electric rotational tool as a whole in terms of the structure and layout.

Furthermore, driving switches in conventional electric rotational tools have a structure that employs either a push operating system or a lever operating system, so that in cases where it is desired, for example, to change from a push operating system to a lever operating system, or vice-versa, in accordance with changes in the nature of the work involved, etc., it is necessary to prepare in advance electric rotational tools having driving switch systems with the above-described two different types of operating systems. Accordingly, if driving switches with the two different types of operating systems are installed in a single electric rotational tool, and the tool is constructed so that one or the other operating system can be selected and used as required, then the range of use of the electric rotational tool can be increased, so that an electric rotational tool with much more convenient handling can be obtained.

Accordingly, the present inventor, as a result of diligent research and the structure of numerous prototypes, confirmed the following: with the use of a combination of a magnet and a magnetic sensor, attaching the magnet to the shaft part that supports the rotational tool or to a switch lever installed in the grip portion of the electric rotational tool, connecting the magnetic sensor to the power circuit of the electric motor, disposing this sensor in the displacement position of the magnet, and operating the rotational tool by pushing (i.e., using a push operating system) or operating the lever by pushing (i.e., using a lever operating system), so that the magnet is caused to approach the magnetic sensor, the magnetic sensor will sense the magnetism and switch the power circuit ON, so that the electric motor can be rotationally driven in a simple manner.

In this case, it was confirmed that if a Hall element is used as the magnetic sensor in the driving switch of the above-described structure, the power circuit can also be made extremely small and compact by way of using an IC circuit, so that a driving switch that allows the use of both the push operating system and lever operating system can easily be installed in a single electric rotational tool. Especially in cases where a brushless motor is used as the electric motor, the driving switch and the electric motor driving control circuit can both be accommodated in a compact manner inside the grip portion casing of the electric rotational tool, so that handling is convenient.

Furthermore, in cases where a driving switch with two different types of operating systems is thus installed, the efficiency of the work can be increased and the safety of the work can also be improved by constructing the tool so that switching which allows selective use of either operating system is possible. Furthermore, by applying the above-described conventional torque detection means and torque-set automatic stopping means when the work is completed, it is possible to achieve appropriate tightening work of screws, etc. and to stop the driving of the electric motor, so that a transition to the waiting state for the next operation can be made quickly and smoothly.

Accordingly, the object of the present invention is to provide an electric rotational tool driving switch system in which driving control by means of a desired push operating system or lever operating system can be selectively performed in accordance with the content of the work when the electric rotational tool is used, an appropriate tightening work of screws, etc. can be always performed efficiently, and handling of the tool can be simplified and safety can be sufficiently improved.

DISCLOSURE OF INVENTION

In order to accomplish the above-described object, the electric rotational tool driving switch system of the present invention is characterized in that the electric rotational tool is comprised of an electric motor, a rotational tool, such as a driver bit, etc., which is connected to an output shaft of the electric motor and which performs work, such as tightening of screws, etc., a driving switch which initiates the work performed by the rotational tool by driving the electric motor, a torque detection means which detects a load torque generated in the rotational tool when the work is completed, and a torque-set automatic stopping means which stops driving of the rotational tool when the load torque reaches a preset torque value; and in this electric rotational tool, a driving switch of a push operating system which switches the electric motor ON when the rotational tool is caused to contact a work object such as a screw, etc. and displaced by being pressed, and a driving switch of a lever operating system which switches the electric motor ON when a switch lever installed in a grip portion of the electric rotational tool is displaced by being pressed, are respectively constructed by combining magnets and magnetic sensors; and the magnetic sensors are respectively connected to a power circuit of the electric motor so that either one of the operating systems is selected, and driving of the electric motor is initiated by switching the power circuit ON through magnetism sensing action of the magnetic sensor of a selected operating system.

In this case, the driving switch of the push operating system can be comprised of a supporting shaft that supports the rotational tool and is coupled by a shaft coupling so that the supporting shaft is allowed to make elastic displacement in an axial direction thereof, a magnet installed in a displacement portion of the supporting shaft, and a magnetic sensor disposed in an outer circumferential portion of the supporting shaft so that the magnetic sensor faces the magnet; and the driving switch of the lever operating system is comprised of a magnet which is installed in a displacement portion of the switch lever installed in a portion of a grip portion casing of the electric rotational tool, and a magnetic sensor which is disposed in the grip portion casing so that the magnetic sensor faces the magnet; wherein driving of the electric motor is initiated by switching the power circuit ON through the magnetism sensing action of the magnetic sensor of whichever driving switch is selected.

Furthermore, a brushless motor can be used as the electric motor, and the driving control circuit and power circuit of the brushless motor can be both accommodated inside the grip portion casing of the electric rotational tool.

Furthermore, in the electric rotational tool driving switch system of the present invention, the power circuit of the electric motor can be formed as a circuit that powers the electric motor by means of a magnetic sensor that performs a magnetism sensing action using the push operating system and as a circuit that powers the electric motor by means of a magnetic sensor that performs a magnetism sensing action using a lever operating system, wherein a selection switch is provided so that a formation of a power circuit that initiates driving of the electric motor by either one of the operating systems can be selected.

In this case, the selection switch can be constructed so that a magnet is disposed on a portion of the switch lever in an area where a connection between the grip portion casing of the electric rotational tool and the switch lever is made, and a magnetic sensor is disposed on the grip portion casing side so that the sensor faces the magnet, wherein automatic selection and switching is performed in the power circuit so that driving of the electric motor is initiated by the push operating system when the switch lever is removed and driving of the electric motor is initiated by the lever operating system when the switch lever is attached.

Furthermore, in the electric rotational tool driving switch system of the present invention, a forward-reverse conversion switch that is operated from outside can be disposed on a portion of the grip portion casing of the electric rotational tool, wherein in cases where the electric motor is converted from a forward rotation to a reverse rotation when work such as removing of screws, etc. is performed, the power circuit deactivates driving of the electric motor by the push operating system and allows driving of the electric motor to be initiated only by the lever operating system.

Furthermore, in the electric rotational tool driving switch system of the present invention, a clutch mechanism can be provided as a torque detection means installed in the grip portion casing of the electric rotational tool; and in this case, a torque adjustment mechanism that acts on the clutch mechanism is disposed so as to protrude at a slight inclination with respect to the supporting shaft of the rotational tool that protrudes vertically downward from the grip portion casing.

BEST MODE FOR CARRYING OUT THE INVENTION

Next, embodiments of the electric rotational tool driving switch system of the present invention will be described in detail with reference to the accompanying drawings.

Figure 1:
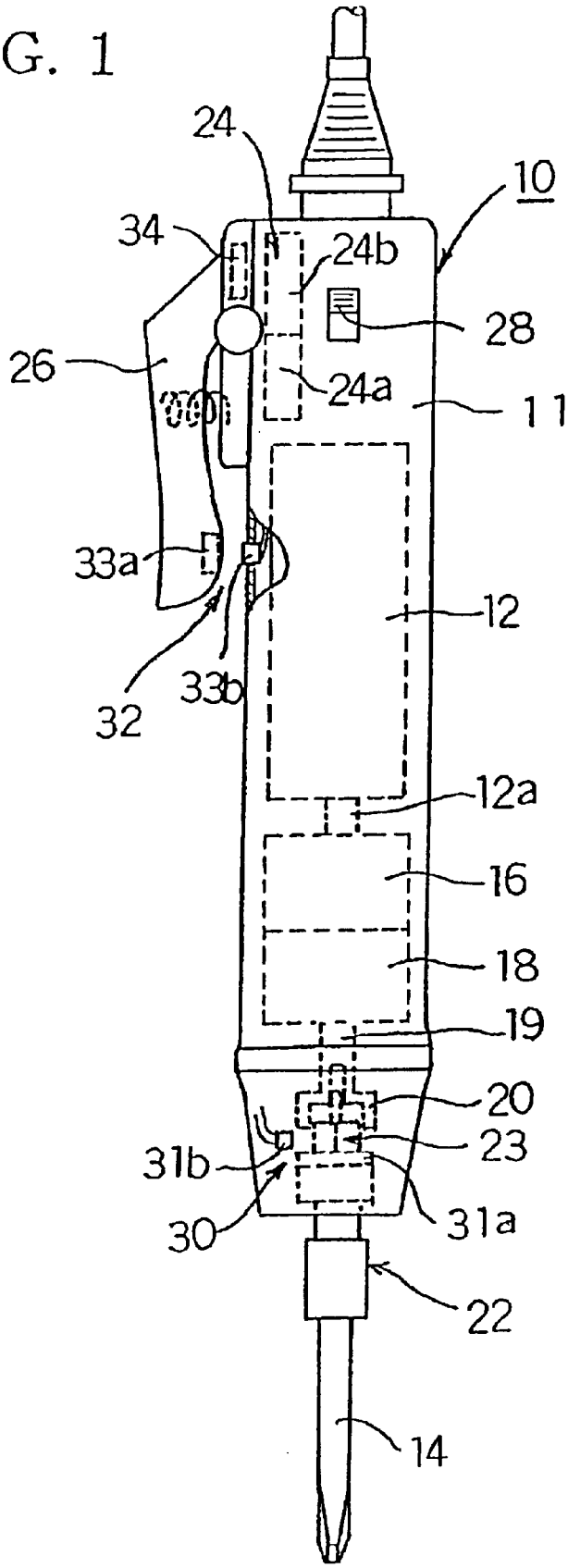
FIG. 1 is a schematic structural diagram that shows one embodiment of the electric rotational tool equipped with the driving switch system according to the present invention.

FIG. 1 shows one embodiment of an electric rotational tool embodying the driving switch system of the present invention. More specifically, in FIG. 1, the reference symbol 10 indicates an electric rotational tool such as an electric driver, etc. An electric motor 12, such as a brushless motor, etc., is installed inside this electric rotational tool 10, and a rotational tool 14, such as a driver bit, etc., is attached to the tip end portion of this electric rotational tool 10 in a manner that allows detachment and replacement. The rotational tool 14 is driven by the driving of the electric motor 12, so that work, such as tightening of screws, etc., is performed.

A speed reduction mechanism 16 comprising, for example, a planetary gear mechanism, etc., is installed on the motor output shat 12*a* of the electric motor 12, and a torque detection means 18 which detects the load torque generated in the rotational tool 14 during work, such as the tightening of screws, etc., are installed between this speed reduction mechanism 16 and the rotational tool 14. In this case, a bit chuck mechanism 22 is connected via a shaft coupling 20 to the tip end of a drive shaft 19 which protrudes from the torque detection means 18 connected to the motor output shaft 12*a* of the electric motor 12 via the speed reduction mechanism 16, and a rotational tool 14, such as a driver bit, etc., is attached to this bit chuck mechanism 22 in a manner that allows detachment and replacement.

In the electric rotational tool 10 of the present embodiment constructed as described above, a driving control circuit 24, which is comprised of a driving circuit 24*a* which drives the electric motor 12, and a torque-set automatic stopping circuit 24*b* which stops the driving of the rotational tool 14, i.e., the driving of the electric motor 12, when the load torque generated in the rotational tool 14 upon the completion of work, such as the tightening of screws, etc., reaches a preset torque value detected by the torque detection means 18, is accommodated in a specified space inside the grip portion casing 11 of the electric rotational tool 10.

Furthermore, a switch lever 26 that can be operated from the outside is attached to one side portion of the outer circumference of the grip portion casing 11 of the electric rotational tool 10, and a forward-reverse conversion switch 28 that is used for appropriate conversion of the forward and reverse rotation of the electric motor 12 is also appropriately attached to this side portion.

Figure 2:
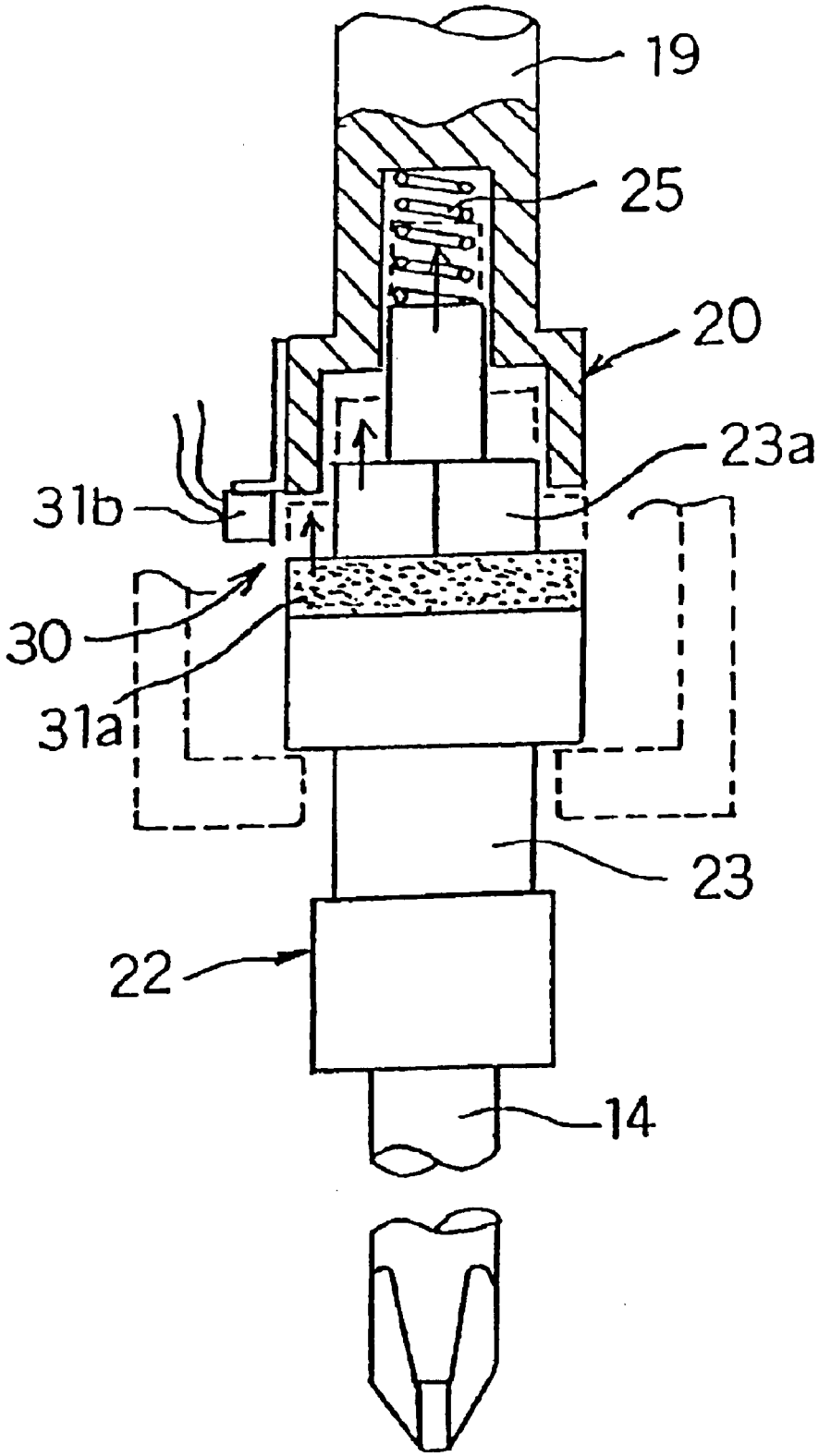
FIG. 2 is an enlarged explanatory diagram of the essential portion, showing the structure and operating conditions of the driving switch of a push operating system in the electric rotational tool of the present invention.

Moreover, in the present embodiment, a magnet 31*a* and a magnetic sensor 31*b* comprising a Hall element, etc. are combined to form a driving switch 30 of a push operating system which switches the electric motor ON when the rotational tool 14 is displaced by pushing the tool against the work object such as a screw, etc. In this case, as shown in detail in FIG. 2, the driving switch 30 of the push operating system is constructed as follows: the magnet 31*a* which is formed in a ring shape is fit over and fastened to the supporting shaft 23 of the bit chuck mechanism 22 that supports the rotational tool 14, and the end portion 23*a* of this supporting shaft 23 is connected to the drive shaft 19 of the torque detection means 18 via a shaft coupling 20 so that supporting shaft 23 is anchored in the rotational direction and is allowed to make elastic displacement in the axial direction.

Furthermore, in the area where the supporting shaft 23 is connected to the shaft coupling 20, the end portion 23*a* of the supporting shaft 23 is caused to protrude, and this protruding portion is elastically held via spring means 25, etc., so that the supporting shaft 23 can be elastically displaced when the rotational tool 14 is displaced by being pressed. Moreover, the magnetic sensor 31*b* is disposed on the outer circumferential portion of the supporting shaft 23 so that this sensor faces the displaced position of the magnet 31*a* that is fit over and fastened to the supporting shaft 23.

Furthermore, a driving switch 32 of a lever operating system, which switches the electric motor ON when the switch lever 26 disposed on the grip portion casing 11 of the electric rotational tool 10 is displaced by being pressed, is constructed in the same manner as described above from a magnet 33*a* and a magnetic sensor 33*b* which is a Hall element, etc. In this case, as shown in an enlarged view in FIG. 3, the driving switch 32 of the lever operating system is constructed as follows: a magnet 33*a* is disposed in the displacement portion of the switch lever 26 installed in a portion of the grip portion casing 11 of the electric rotational tool 10, and a magnetic sensor 33*b* is disposed on the grip portion casing 11 side so that the magnetic sensor 33*b* faces the magnet 33*a*.

The driving switch 30 of the push operating system and the driving switch 32 of the lever operating system constructed as described above are arranged as follows: the magnetic sensors 31*b* and 33*b* are respectively connected to the power circuit of the electric motor 12, so that either of the above-described operating systems can be switched via a selection switch 34, and driving of the electric motor 12 can be initiated by switching the power circuit ON by means of the magnetism sensing action of the magnetic sensor 31*b* or 33*b* of the operating system that is selected.

For example, as shown in FIG. 1, the selection switch 34 is preferably provided in the attachment base, etc. of the switch lever 26 of the electric rotational tool 10, and it can be set so that a switching operation from the lever operating system to the push operating system can be performed when the switch lever 26 is removed. Meanwhile, in the case of switching from the push operating system to the lever operating system, the selection state of the above-described operating systems can easily be discriminated according to the respective state of the switch lever 26 by attaching the switch lever 26 after switching the selection switch 34 to the lever operating system.

Figure 3:
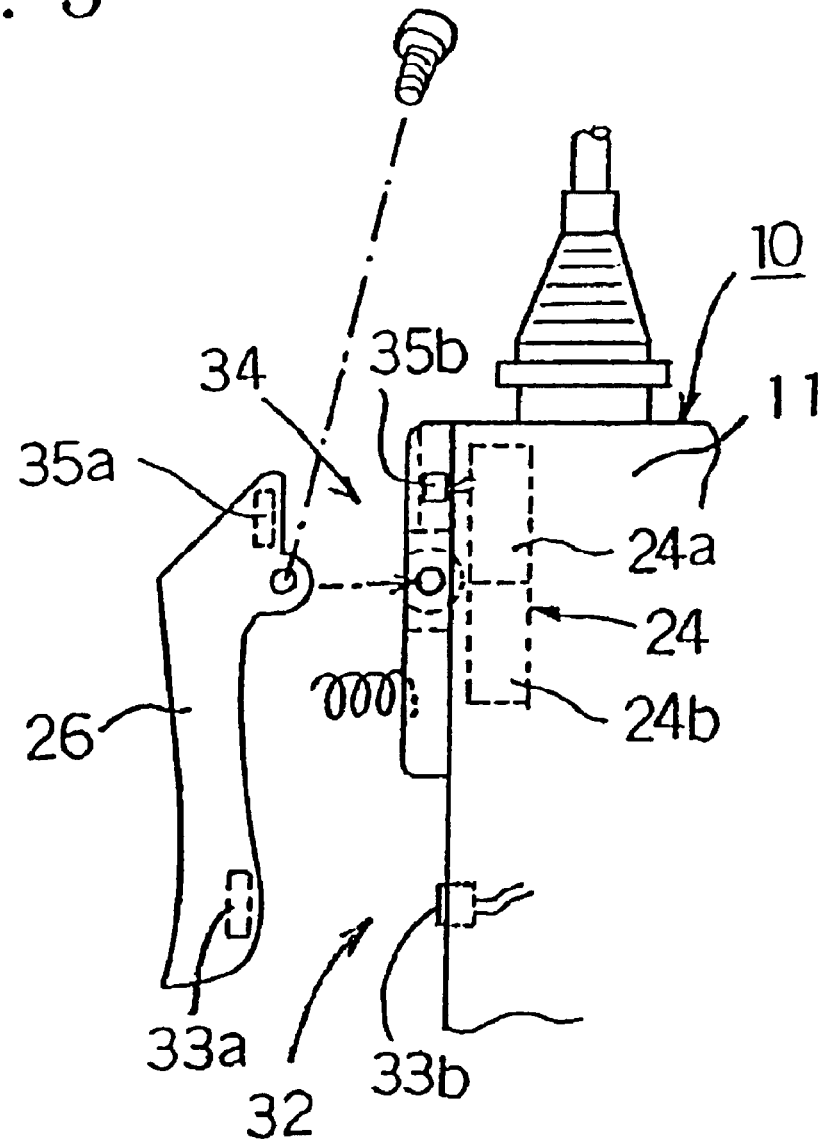
FIG. 3 is an explanatory diagram of the essential portion, showing another embodiment of the selection switch of a driving switch system in the electric rotational tool shown in FIG. 1.

As an alternative, the selection switch 34 can be constructed as follows: as shown in FIG. 3, a magnet 35*a* is disposed in a portion of the switch lever 26 in the area where a connection between the grip portion casing 11 of the electric rotational tool 10 and the switch lever 26 is made, and a magnetic sensor 35*b* is disposed on the grip portion casing 11 side so that the sensor faces the magnet 35*a*. Furthermore, a power circuit, which initiates the driving of the electric motor 12 by a push operating system when the switch lever 26 is removed from the grip portion casing 11 or which initiates the driving of the electric motor 12 by a lever operating system when the switch lever 26 is attached to the grip portion casing 11, is set so as to be automatically selected and switched. With the use of this structure, it is possible to construct both of the driving switches 30 and 32 as non-contact switches. Accordingly, various types of noise and the generation of frictional parts can be prevented, thus making a substantial contribution to an increased useful life and maintenance-free operation in an electric rotational tool of this type.

Figure 4:
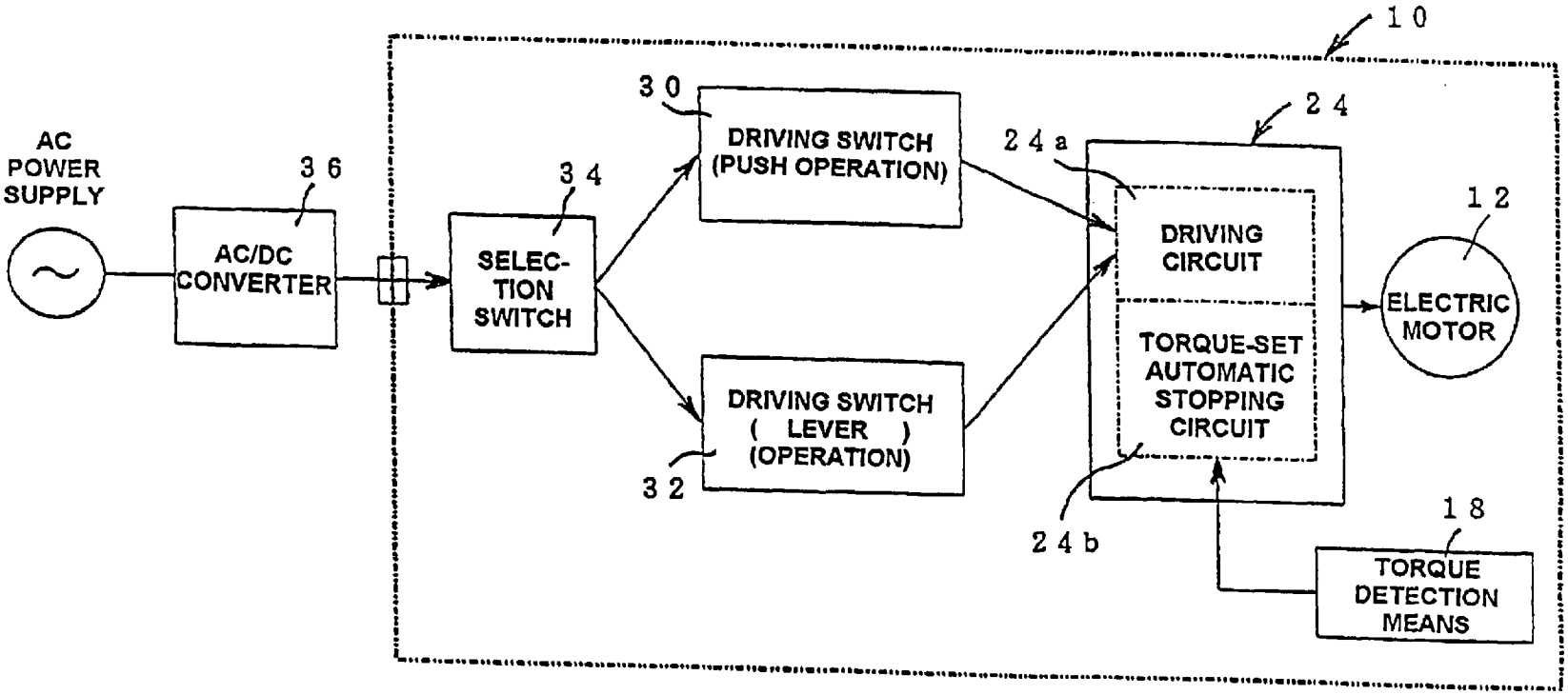
FIG. 4 is a block diagram that shows an example of the structure of the power circuit of an electric motor embodying the driving switch system in the electric rotational tool shown in FIG. 1.

FIG. 4 is a block circuit diagram that shows an example of the structure of the power circuit in which the driving of the electric motor 12 is initiated by the driving switches 30 and 32 and the driving of the electric motor 12 is automatically stopped by the torque detection means 18. More specifically, FIG. 4 shows a case in which a brushless motor, for example, is used as the electric motor 12. In this structure, a driving control circuit 24 which combines an electric motor driving circuit 24*a* and a torque-set automatic stopping circuit 24*b* is installed in the electric rotational tool 10, and this circuit is connected to an external AC power supply via an AC/DC converter 36. Furthermore, in cases where one of the operating systems is selected by the selection switch 34, power is supplied to the electric motor 12 from the AC power supply via the AC/DC converter 36, selection switch 34, and driving switch 30 or 32, so that the driving of the electric motor 12 can be initiated by the electric motor driving circuit 24*a* of the driving control circuit 24.

Next, when specific work, such as the tightening of a screw, etc., is completed by the rotational driving of the rotational tool 14 that accompanies the driving of the electric motor 12, the load torque that is generated in the rotational tool 14 is detected by the torque detection means 18, and when this detected load torque reaches a preset torque value, the driving of the electric motor 12 is stopped by the torque-set automatic stopping circuit 24*b* of the driving control circuit 24, thus making a transition to a state of waiting for the next work operation. In this case, a system that detects the torque by means of the above-described conventional universally known clutch mechanism or a system that detects the torque by means of the load current can be appropriately employed as the torque detection means 18.

Figure 5:
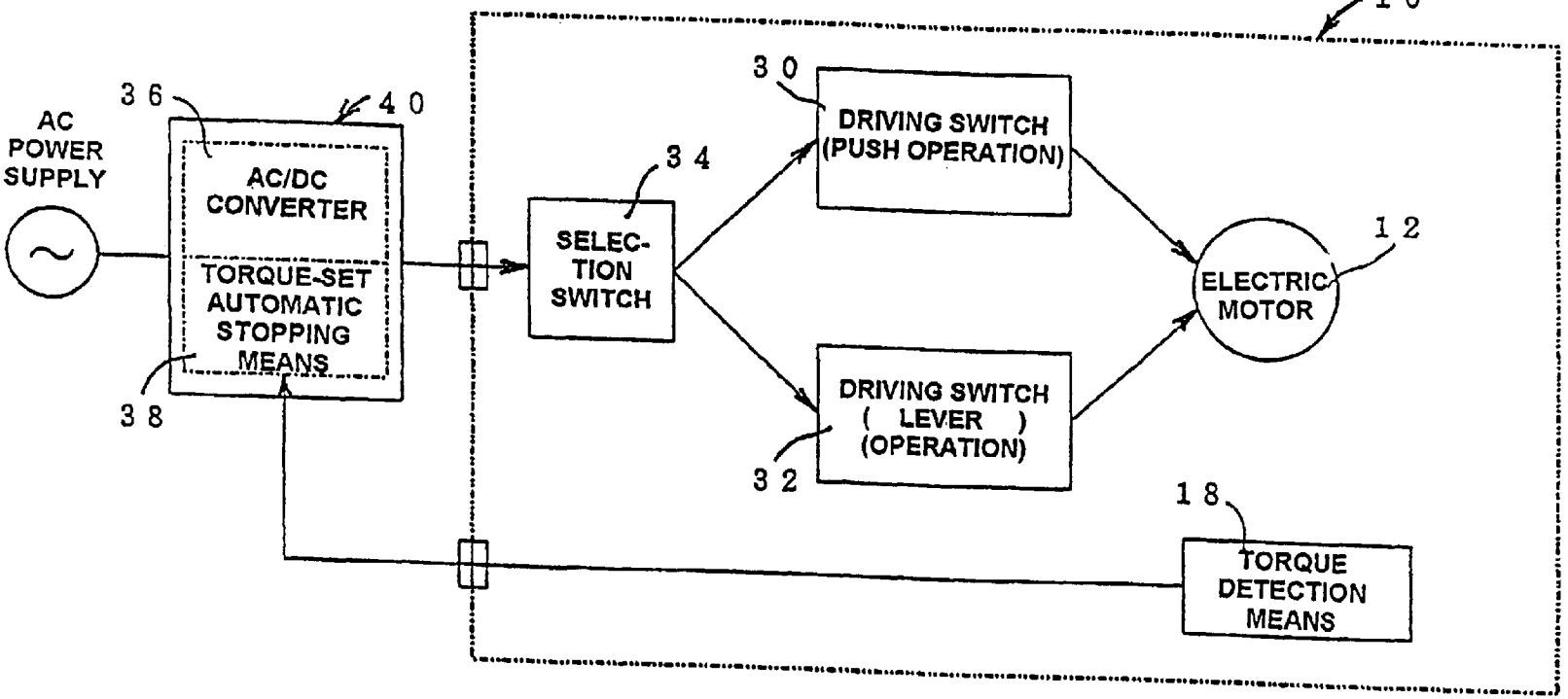
FIG. 5 is a block diagram that shows a modification of the power circuit of an electric motor embodying the driving switch system in the electric rotational tool shown in FIG. 4.

FIG. 5 is a block circuit diagram that shows a modification of the above-described power circuit shown in FIG. 4. In particular, FIG. 5 shows a case in which a common DC motor is used as the electric motor 12. In this structure, the electric rotational tool 10 does not contain a driving control circuit, etc. but is rather connected to an external AC power supply via a control unit 40 which combines an AC/DC converter 36 and torque-set automatic stopping means 38. Furthermore, when one or the other operating system is selected by the selection switch 34, power is supplied to the electric motor 12 from the AC power supply via the AC/DC converter 36 of the control unit 40, the selection switch 34, and the driving switch 30 or 32, so that driving of the electric motor 12 can be initiated.

Next, when specific work, such as the tightening of a screw, etc., is completed by the rotational driving of the rotational tool 14 that accompanies the driving of the electric motor 12, the load torque that is generated in the rotational tool 14 is detected by the torque detection means 18, and when this detected load torque reaches a preset torque value, the driving of the electric motor 12 is stopped by the torque-set automatic stopping circuit 38 of the control unit 40, so that a transition to a state of waiting for the next work operation can be made.

In the above-described electric rotational tool driving switch system of the present invention, when work, such as removing of screws, etc., is to be performed, such work can be performed by operating the forward-reverse conversion switch 28, so that the electric motor 12 is caused to rotate in the reverse direction with respect to the forward rotation performed in the above-described work such as the tightening of screws, etc. In this case, if the push operating system is selected for the operation of the electric motor 12 and the driving switch is operated, the load torque cannot be detected by the torque detection means 18 when removal of the screw is completed, so that automatic stopping of the driving of the electric motor 12 by torque-set automatic stopping means, etc. is difficult. Furthermore, the problems involved are that if the driving of the electric motor 12 is not stopped, and the rotational tool 14 is rotationally driven even after the removal of the screw is completed, then the screw or screw hole may be damaged.

Accordingly, in the electric rotational tool driving switch system of the present embodiment, the power circuit is constructed so that the driving of the electric motor 12 by the push operating system is disabled in cases where the forward-reverse conversion switch 28 is operated so that the electric motor 12 is converted from forward rotation to reverse rotation when work, such as removing of screws, etc., is performed, and the power circuit is constructed so that the driving of the electric motor 12 can be initiated only by the lever operating system. Accordingly, as a result of the use of this structure, in cases where work, such as removing of screws, etc., is performed, the driving of the electric motor 12 is stopped by manual release of the lever operation in accordance with the visual and tactile sensor functions of the operator when the removal of the screw is completed, thus accomplishing accurate and safe work.

Figure 6:
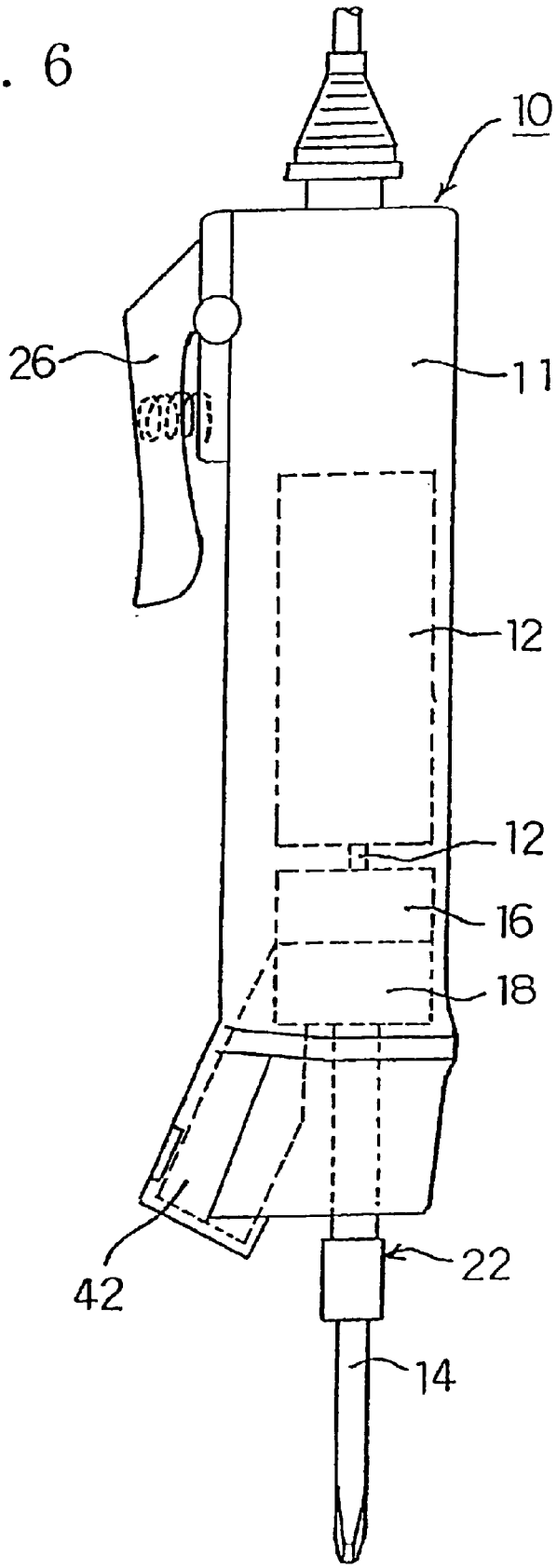
FIG. 6 is a schematic structural diagram showing another embodiment of an electric rotational tool equipped with the driving switch system of the present invention.

FIG. 6 shows a modification of an electric rotational tool embodying the driving switch system of the present invention. More specifically, in this embodiment, an ordinary torque adjustment mechanism that can be operated from the outside is installed in a case where a system which detects torque by means of a clutch mechanism is used as the torque detection means 18. Conventionally, a torque adjustment mechanism of this type is ordinarily installed coaxially with the supporting shaft of the rotational tool 14 in a position that surrounds the circumference of this tool. However, in cases where the electric rotational tool is used in combination with an automatic operating mechanism, etc., various mechanisms are combined and disposed on the circumference of the supporting shaft of the rotational tool 14. Accordingly, when the driving switch system of the present invention is applied, the installation positions of the driving switches and torque adjustment mechanism compete for space with the various above-described types of mechanisms, so that the grip portion casing 11 must be enlarged in order to ensure installation space for these parts. Furthermore, in cases where adjustment of the torque adjustment mechanism is performed, the various types of mechanisms that are installed in combination on the circumference of the supporting shaft of the rotational tool 14 must all be removed. Accordingly, not only is the adjustment work bothersome, but also the electric rotational tool must be reset, etc., and the work becomes conspicuously difficult.

Accordingly, in the present embodiment, as shown in FIG. 6, it is characterized in that the installation position of the torque adjustment mechanism 42 with respect to the torque detection means 18 is caused to protrude at a slight inclination with respect to the supporting shaft 23 of the rotational tool 14 that protrudes vertically downward from the grip portion casing 11. A description of the remaining structure, e.g., the structure and disposition of the driving switches, etc., is omitted, but the structure is basically the same as the structure in the electric rotational tool 10 shown in FIG. 1. Furthermore, in FIG. 6, the same constituent elements are labeled with the same reference symbols, and a detailed description of such elements is omitted.

Accordingly, the electric rotational tool 10 of the present embodiment constructed as described above provides the following advantages: the grip portion casing 11 can be set at minimum dimensions, and the operation of the torque adjustment mechanism 42 and maintenance work, etc. on the torque adjustment mechanism 42 can be performed with absolutely no need to perform work such as removing of various types of mechanisms disposed on the rotational tool 14 side. Likewise, the following advantage is also obtained: when a detachment operation or maintenance work, etc. is performed on the rotational tool 14, such work can be performed with absolutely no effect on the torque adjustment mechanism 42 side. Furthermore, a structure of the torque adjustment mechanism 42 so that this mechanism acts at an angle with respect to the clutch mechanism of the torque detection means 18 can easily be accomplished merely by altering the shape of a portion of the clutch mechanism, so that there is no increase in the manufacturing cost.

Preferred embodiments of the present invention are described above. However, the present invention is not limited to the above-described embodiments; and numerous design changes can be made within the limits that involve no departure from the spirit of the present invention.

Merits of the Invention

As is clear from the embodiments described above, the electric rotational tool driving switch system of the present invention includes an electric motor, a rotational tool, such as a driver bit, etc., which is connected to the output shaft of this electric motor and which performs work, such as the tightening of screws, etc., a driving switch which initiates the above-described work performed by the rotational tool by driving the electric motor, a torque detection means which detects the load torque generated in the rotational tool when the above-described work is completed, and a torque-set automatic stopping means which stops the driving of the rotational tool when the above-described load torque reaches a preset torque value; and in this structure, a driving switch of a push operating system, which switches the electric motor ON when the rotational tool is caused to contact the work object such as a screw, etc. and displaced by being pressed, and a driving switch of a lever operating system, which switches the electric motor ON when a switch lever installed in the grip portion of the electric rotational tool is displaced by being pressed, are respectively constructed by combining magnets and magnetic sensors, and the magnetic sensors are respectively connected to the power circuit of the electric motor, so that either of the above-described operating systems can be selected, and the driving of the electric motor is initiated by switching the power circuit ON through the magnetism sensing action of the magnetic sensor of the selected operating system. Accordingly, when the electric rotational tool is used, driving control using the desired push operating system or lever operating system can be selectively performed in accordance with the content of the work, so that an appropriate tightening work of screws, etc. can be always performed efficiently, and so that handling can be simplified and safety can be sufficiently improved.

Furthermore, in the electric rotational tool driving switch system of the present invention, the above-described driving switch of the push operating system is constructed by connecting the rotational tool by a shaft coupling so that the supporting shaft that supports the rotational tool is allowed to make elastic displacement in the axial direction, installing a magnet in the displacement portion of this supporting shaft, and disposing a magnetic sensor in the outer circumferential portion of the supporting shaft so that this magnetic sensor faces the magnet; the driving switch of the lever operating system is constructed by installing a magnet in the displacement portion of a switch lever installed in a portion of the grip portion casing of the electric rotational tool, and disposing a magnetic sensor on the grip portion casing side so that this magnetic sensor faces the magnet; and a selection switch is installed which allows selection so that a power circuit that initiates the driving of the electric motor can be formed by either one of the above-described operating systems. Accordingly, driving switches that allow the use of both a push operating system and a lever operating system can easily be installed in a single electric rotational tool by a simple structure. Especially in cases where a brushless motor is used as the electric motor, numerous superior advantages can be obtained: e.g., the driving switches can both be accommodated in a compact manner inside the grip portion casing of the electric rotational tool together with the driving control circuit of the electric motor, a long useful life and maintenance-free operation based on overall non-contact operation can be realized, and handling can be simplified.

Furthermore, in the electric rotational tool driving switch system of the present invention, a forward-reverse conversion switch that can be operated from the outside is disposed in a portion of the grip portion casing of the electric rotational tool; and in cases where the electric motor is converted from forward rotation to reverse rotation when work, such as removing of screws, etc., is performed, the power circuit is set so that the driving of the electric motor by the push operating system is disabled, and the power circuit is set so that the driving of the electric motor is initiated only by the lever operating system. Accordingly, in cases where work, such as removing of screws, etc., is performed, the driving of the electric motor 12 is stopped by manual release of the lever operation in accordance with the visual and tactile sensory functions of the operator when the removal of the screw is completed. Consequently, problems such as generation of cutting debris by idling of the rotational tool with the screw can be prevented, and accurate and safe work can be accomplished.

Furthermore, in the electric rotational tool driving switch system of the present invention, a clutch mechanism can be utilized as a torque detection means installed in the grip portion casing; and in this case, the torque adjustment mechanism that acts on the clutch mechanism is disposed protruding at a slight inclination with respect to the supporting shaft of the rotational tool that protrudes vertically downward from the grip portion casing. Accordingly, the grip portion casing can be set at minimum dimensions, the combined installation of the driving switches and torque adjustment mechanism can be facilitated, operation of the tool and maintenance work can be smoothly performed without the rotational tool and torque adjustment mechanism having any effect on each other, and an electric rotational tool with easy handling is obtainable.

What is claimed is:

1. An electric rotational tool driving switch system characterized in that said electric rotational tool is comprised of an electric motor, a rotational tool, such as a driver bit, etc., which is connected to an output shaft of said electric motor and which performs work, such as tightening of screws, etc., a driving switch which initiates said work performed by said rotational tool by driving said electric motor, a torque detection means which detects a load torque generated in said rotational tool when said work is completed, and a torque-set automatic stopping means which stops driving of said rotational tool when said load torque reaches a preset torque value, wherein a driving switch of a push operating system, which switches said electric motor ON when said rotational tool is caused to contact a work object such as a screw, etc. and displaced by being pressed, and a driving switch of a lever operating system, which switches said electric motor ON when a switch lever installed in a grip portion of said electric rotational tool is displaced by being pressed, are respectively constructed by combining magnets and magnetic sensors; and said magnetic sensors are respectively connected to a power circuit of said electric motor so that either one of said operating systems is selected, and driving of said electric motor is initiated by switching said power circuit ON through magnetism sensing action of said magnetic sensor of a selected operating system.

2. The electric rotational tool driving switch system according to claim 1, characterized in that:

said driving switch of said push operating system is comprised of a supporting shaft that supports said rotational tool and is coupled by a shaft coupling so that said supporting shaft is allowed to make elastic displacement in an axial direction thereof, a magnet installed in a displacement portion of said supporting shaft, and a magnetic sensor disposed in an outer circumferential portion of said supporting shaft so that said magnetic sensor faces said magnet; and said driving switch of said lever operating system is comprised of a magnet which is installed in a displacement portion of said switch lever installed in a portion of a grip portion casing of said electric rotational tool, and a magnetic sensor which is disposed in said grip portion casing so that said magnetic sensor faces said magnet;

wherein driving of said electric motor is initiated by switching said power circuit ON through said magnetism sensing action of said magnetic sensor of whichever driving switch is selected.

3. The electric rotational tool driving switch system according to claim 2, characterized in that a forward-reverse conversion switch that is operable from outside is disposed on a portion of said grip portion casing of said electric rotational tool, wherein in cases where said electric motor is converted from a forward rotation to a reverse rotation when work such as removing of screws, etc. is performed, said power circuit deactivates driving of said electric motor by said push operating system and allows driving of said electric motor to be initiated only by said lever operating system.

4. The electric rotational tool driving switch system according to claim 3, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

5. The electric rotational tool driving switch system according to claim 2, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

6. The electric rotational tool driving switch system according to claim 1 or 2, characterized in that a brushless motor is used as said electric motor, and said driving control circuit and power circuit of said brushless motor are both accommodated inside said grip portion casing of said electric rotational tool.

7. The electric rotational tool driving switch system according to claim 6, characterized in that:

said power circuit of said electric motor is formed as a circuit that powers said electric motor by means of a magnetic sensor that performs a magnetism sensing action using a push operating system and as a circuit that powers said electric motor by means of a magnetic sensor that performs a magnetism sensing action using a lever operating system;

wherein a selection switch is provided so that a formation of a power circuit that initiates driving of said electric motor by either one of said operating systems can be selected.

8. The electric rotational tool driving switch system according to claim 7, characterized in that:

said selection switch is constructed so that a magnet is disposed on a portion of said switch lever in an area where a connection between said grip portion casing of said electric rotational tool and said switch lever is made, and a magnetic sensor is disposed on said grip portion casing side so that said sensor faces said magnet, wherein automatic selection and switching is performed in said power circuit so that driving of said electric motor is initiated by said push operating system when said switch lever is removed and driving of said electric motor is initiated by said lever operating system when said switch lever is attached.

9. The electric rotational tool driving switch system according to claim 8, characterized in that a forward-reverse conversion switch that is operable from outside is disposed on a portion of said grip portion casing of said electric rotational tool, wherein in cases where said electric motor is converted from a forward rotation to a reverse rotation when work such as removing of screws, etc. is performed, said power circuit deactivates driving of said electric motor by said push operating system and allows driving of said electric motor to be initiated only by said lever operating system.

10. The electric rotational tool driving switch system according to claim 9, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

11. The electric rotational tool driving switch system according to claim 8, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

12. The electric rotational tool driving switch system according to claim 7, characterized in that a forward-reverse conversion switch that is operable from outside is disposed on a portion of said grip portion casing of said electric rotational tool, wherein in cases where said electric motor is converted from a forward rotation to a reverse rotation when work such as removing of screws, etc. is performed, said power circuit deactivates driving of said electric motor by said push operating system and allows driving of said electric motor to be initiated only by said lever operating system.

13. The electric rotational tool driving switch system according to claim 12, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

14. The electric rotational tool driving switch system according to claim 7, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

15. The electric rotational tool driving switch system according to claim 6, characterized in that a forward-reverse conversion switch that is operable from outside is disposed on a portion of said grip portion casing of said electric rotational tool, wherein in cases where said electric motor is converted from a forward rotation to a reverse rotation when work such as removing of screws, etc. is performed, said power circuit deactivates driving of said electric motor by said push operating system and allows driving of said electric motor to be initiated only by said lever operating system.

16. The electric rotational tool driving switch system according to claim 15, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

17. The electric rotational tool driving switch system according to claim 6, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

18. The electric rotational tool driving switch system according to claim 1 or 2, characterized in that:

said power circuit of said electric motor is formed as a circuit that powers said electric motor by means of a magnetic sensor that performs a magnetism sensing action using a push operating system and as a circuit that powers said electric motor by means of a magnetic sensor that performs a magnetism sensing action using a lever operating system;

wherein a selection switch is provided so that a formation of a power circuit that initiates driving of said electric motor by either one of said operating systems can be selected.

19. The electric rotational tool driving switch system according to claim 18, characterized in that:

said selection switch is constructed so that a magnet is disposed on a portion of said switch lever in an area where a connection between said grip portion casing of said electric rotational tool and said switch lever is made, and a magnetic sensor is disposed on said grip portion casing side so that said sensor faces said magnet, wherein automatic selection and switching is performed in said power circuit so that driving of said electric motor is initiated by said push operating system when said switch lever is removed and driving of said electric motor is initiated by said lever operating system when said switch lever is attached.

20. The electric rotational tool driving switch system according to claim 19, characterized in that a forward-reverse conversion switch that is operable from outside is disposed on a portion of said grip portion casing of said electric rotational tool, wherein in cases where said electric motor is converted from a forward rotation to a reverse rotation when work such as removing of screws, etc. is performed, said power circuit deactivates driving of said electric motor by said push operating system and allows driving of said electric motor to be initiated only by said lever operating system.

21. The electric rotational tool driving switch system according to claim 20, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

22. The electric rotational tool driving switch system according to claim 19, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

23. The electric rotational tool driving switch system according to claim 18, characterized in that a forward-reverse conversion switch that is operable from outside is disposed on a portion of said grip portion casing of said electric rotational tool, wherein in cases where said electric motor is converted from a forward rotation to a reverse rotation when work such as removing of screws, etc. is performed, said power circuit deactivates driving of said electric motor by said push operating system and allows driving of said electric motor to be initiated only by said lever operating system.

24. The electric rotational tool driving switch system according to claim 23, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

25. The electric rotational tool driving switch system according to claim 18, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

26. The electric rotational tool driving switch system according to claim 1, characterized in that a forward-reverse conversion switch that is operable from outside is disposed on a portion of said grip portion casing of said electric rotational tool, wherein in cases where said electric motor is converted from a forward rotation to a reverse rotation when work such as removing of screws, etc. is performed, said power circuit deactivates driving of said electric motor by said push operating system and allows driving of said electric motor to be initiated only by said lever operating system.

27. The electric rotational tool driving switch system according to claim 26, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

28. The electric rotational tool driving switch system according to claim 1, characterized in that a clutch mechanism is provided as a torque detection means installed in said grip portion casing of said electric rotational tool, and a torque adjustment mechanism that acts on said clutch mechanism is disposed so as to protrude at a slight inclination with respect to said supporting shaft of said rotational tool that protrudes vertically downward from said grip portion casing.

* * * * *